US010480152B1

(12) United States Patent
Smith

(10) Patent No.: US 10,480,152 B1
(45) Date of Patent: Nov. 19, 2019

(54) SWIVELABLE ADAPTER DEVICE FOR A SKID STEER LOADER

(71) Applicant: Wayne J. Smith, Brookhaven, MS (US)

(72) Inventor: Wayne J. Smith, Brookhaven, MS (US)

( * ) Notice: Subject to any disclaimer, the term of this patent is extended or adjusted under 35 U.S.C. 154(b) by 15 days.

(21) Appl. No.: 15/230,706

(22) Filed: Aug. 8, 2016

Related U.S. Application Data

(60) Provisional application No. 62/387,835, filed on Jan. 7, 2016.

(51) Int. Cl.
*E02F 3/36* (2006.01)

(52) U.S. Cl.
CPC ..... *E02F 3/3681* (2013.01)

(58) Field of Classification Search
CPC ..... B66F 9/125; E02F 3/3609; E02F 3/3622; E02F 3/3672; E02F 3/3677; E02F 3/3681; E02F 3/3686
USPC ..... 37/468; 172/825; 414/686, 723
See application file for complete search history.

(56) References Cited

U.S. PATENT DOCUMENTS 2,281,004 A * 4/1942 Lehmann ..... B66F 9/125 414/641
3,941,262 A 3/1976 MOser
5,098,252 A 3/1992 Sheesley
5,114,299 A 5/1992 Roche et al.
5,393,190 A * 2/1995 Vickary ..... B65G 65/23 187/226
5,562,398 A 10/1996 Knutson
5,938,399 A 8/1999 Knutson
6,360,459 B1 3/2002 Brookhart et al.
2006/0182599 A1 8/2006 Potter et al.
2011/0271562 A1 11/2011 Nesseth

OTHER PUBLICATIONS http://www.paladinattachments.com/Products-Details/94/Tilt-Attach, Sales Literature, 'Tilt Attach', retrieved May 26, 2016.

* cited by examiner

*Primary Examiner* — Saul Rodriguez
*Assistant Examiner* — Brendan P Tighe
(74) *Attorney, Agent, or Firm* — Laurence P. Colton; Smith Tempel Blaha LLC

(57) ABSTRACT

A swivelable adapter device for use with skid steer loaders consists of a mounting plate and a swiveling work tool plate for holding, rotating, and positioning various skid steer attachments. Rotation about a longitudinal axis of skid steer arms is accomplished using a barrel within a barrel assembly allowing work tool plate to be positioned from angles between horizontal and vertical. A mounting plate is attached to skid steer arms and is rigidly affixed to an inner barrel. An outer barrel with a notch plate and a work tool plate slides over a greased inner barrel. Swivel operation of the work tool plate is accomplished by hand eliminating the need for hydraulic systems. Once positioned, the work tool plate is locked to a notch plate using a locking latch. The swivelable adapter device is reinforced with metal plates to handle torsion forces created by heavy loads such as trees.

20 Claims, 4 Drawing Sheets

SWIVELABLE ADAPTER DEVICE FOR A SKID STEER LOADER

CROSS-REFERENCE TO RELATED APPLICATIONS

This application claims the benefit of provisional application Ser. No. 62/387,835, "Swivel Adapter, filed Jan. 7, 2016, by the present inventor.

FEDERALLY SPONSORED RESEARCH

Not Applicable

SEQUENCE LISTING OR PROGRAM

Not applicable

BACKGROUND

This device relates to a swivelable adapter device for positioning a variety of work attachments to a skid steer loader. More particularly, this swivelable adapter device provides a means to facilitate attachment of a work tool, and then to rotate the tool using a rotatable forward mounting plate which is pivotally disposable so as to permit work tool engagement of a fallen tree resting at an angle. The invention is further adaptable to various industry skid steer loaders and accepts common skid steer loader attachment tools.

A standard task during tree-trimming cleanup efforts, for example, following a major hurricane, is the removal of downed trees. Many times downed trees are resting precariously on structures and resting at various angles. Tools and devices presently exist to grasp and collect downed trees, but none exists for skid steer loaders that have a manual swivel capability of 90 degrees of rotation. This lack of the capability to grasp a downed tree resting at an angle means possible further damage to a structure.

What is new and unobvious in this present invention is the ability to adapt a work tool to a skid steer loader, attach working implements, then rotate working implements to a range of angles from horizontal to vertical using manual force to rotate, and lock the device in a fixed position.

There is a need for an adapter positioned between a skid steer loader and a work tool attachment that allows addressing of the work tool piece at various angles. Some adapters rotate a few degrees from the typical front mount setting position of horizontal.

The Smith swivel adapter rotates from a horizontal position to a vertical position. The rotation of the swivel adapter is a full ninety degrees from a horizontal position to a vertical position.

Hydraulic system compatibility of an attachment device is a problem for many skid steer loaders because the hydraulic system connector pin to control attachments may differ among various skid steer models. The hydraulic system compatibility problem is overcome in the Smith swivelable adapter device by the elimination of the use of hydraulics to rotate the forward work tool mounting plate. The forward tool mounting plate can easily be rotated manually by hand.

DESCRIPTION OF THE PRIOR ART

The use of skid steer loader attachments is known in prior art.

U.S. Pat. No. 5,562,398, Skid Steer Loader Tiltable Attachment, to Knutson teaches that the attachment maintains the ability of the skid steer loader to move utility attachments in the horizontal and vertical planes while providing the ability to rotate the utility attachment around the longitudinal axis of the skid steer loader. However, the rotation of the Knutson '398 patent is limited to a few angles greater than horizontal and cannot rotate a full 90 degrees.

U.S. Pat. No. 5,938,399, Skid Steer Loader Rotatable Attachment, to Knutson teaches the rotational assembly and work attachment are conjointly rotatable through 360 degrees in a plane. However, the Knutson '399 device relies on hydraulic power as a motive force.

This is a great disadvantage because of the fact that not all manufacturer's hydraulic attachment systems are common. The Knutson '399 grant is limited to skid steer loaders with compatible hydraulic systems.

U.S. Pat. No. 6,360,459, Tiltable Bucket Assembly, to Brookhart et al., teaches a hydraulic cylinder adapted to provide rotational movement of the bucket. The grant is for a device with a limited angle of rotation. The assembly requires the motive force of hydraulics, further limiting its adaptability to a wide range of skid steer loaders that do not have compatible hydraulic systems.

U.S. Pat. No. 3,941,262, Pivotally Disposable Bucket, to Moser teaches a bracket member pivotable to bring the standard cutting edge into engagement with a work surface. The device is a rotatable attachment but not utilized with a skid steer loader.

U.S. Pat. No. 5,114,299, Attachment for a Prime Mover, to Roche et al., teaches a loading bucket pivotally attached to a support frame by a large pivot pin. The patent is for a device with the singular purpose of grappling. The device does not have the capability to attach any of the various work tools available in the market.

US 2011/0271562, to Nesseth, Nov. 10, 2011, describes an implement that is pivotally tiltable relative to the motor vehicle along a plane. However, the device is limited in the range of angles at which the device can be fixed.

US 2006/0182599, to Potter et al., Aug. 17, 2006, describes an adapter for mounting on a work machine comprising an attachment for individually attaching one or more working implements to the work machine and allowing lateral rotation or tilting of the working implement. However, the device purports to establish that degree of relative rotation is determined by the length of slots, thereby limiting the range of angles to a few degrees from horizontal.

U.S. Pat. No. 5,098,252, to Sheesley et al., teaches an adapter mechanism for use with a skid steer loader having an implement mounting plate that permits attachment of an implement. However, this device does not rotate. Therefore, any attached work tool cannot rotate.

Historically, U.S. Pat. No. 2,281,004, Industrial Truck, to Lehmann, teaches changing the position of a load carrier prior to depositing the load.

Accordingly, it would be advantageous to provide a swivelable adapter for a skid steer loader to attach work tool implements that allows for rotation about a longitudinal axis of skid steer loader lift arms, and that is inexpensive, easy to operate, compact, and simple in design.

SUMMARY OF THE INVENTION

In view of the foregoing disadvantages inherent in the known types of skid steer adapters in the prior an, the swivelable adapter provides a solution to the problem of utilizing skid steer loaders to grasp objects at various angles. The swivel adapter is a device to connect work tools to the lift arms of a skid steer and then allow the work tool to be manually rotatable to a desired work angle between horizontal and vertical, either in a direction to the left or to the right, requiring no use of hydraulics.

The general purpose of the present invention is to provide a new, improved swivelable adapter device, a method, which is simpler to use and does not need hydraulics to function. The swivelable adapter device is not anticipated, rendered obvious, suggested, or even implied by any prior art skid steer loader attachment devices, that permits an operator to grasp a leaning tree at working angles from horizontal to vertical.

The swivel adapter device comprises sandwiched metal plates, including a skid steer mounting plate, a notch plate, a swivelable work tool plate, a locking latch, all fitted to a barrel within a barrel assembly.

The adapter is intended for use by attachment to skid steer loader lift arms and to a work attachment tool forward of the invention.

The Smith invention is a device to facilitate attachment of arborist tools to a skid steer loader. The adapter allows a skid steer loader a capability to orient an attached work tool utilizing a barrel within a barrel rotation system, where the work tool plate is rotatable relative to a fixed skid steer mounting plate. The work tool plate is rotatable 90 degrees in a plane transverse to a longitudinal axis of the lift arms of a skid steer loader.

To attain this novelty, the swivelable adapter device comprises an aft mounting plate mountable to skid steer lift arms, a rotational assembly with a lockable feature, and a forward mounting tool plate for attachment of a working tool. As such, the forward mounting plate is swivelable through a radius of 90 degrees, either to the left or to the right, using only gravity to assist the rotation about the longitudinal axis of the lift arms of the skid steer loader. The swivel adapter permits grabbing trees leaning at angles, as in the case of a fallen tree resting on a structure following a storm or hurricane.

There has thus been outlined, broadly, several features of the swivelable adapter device in order that the detailed description thereof that follows may be better understood, and in order that the present improvement of the art may be better appreciated. There are additional features that will be described hereinafter and which form the subject matter of the claims appended.

As such, those skilled in the art will appreciate that the conception, upon which this disclosure is based, may readily be utilized as a basis for the designing of other structures, methods, and systems for carrying out the several objects of the present invention. It is important that the claims be regarded as including such equivalent constructions insofar as they do not depart from the spirit and scope of the swivelable adapter device.

BRIEF DESCRIPTION OF THE DRAWINGS

These and other features, aspects, and advantages of the swivelable adapter device will become better understood with regard to the following description, appended claims, and accompanying drawings. Such description makes reference to the annexed drawings wherein:

FIG. 2 bottom view shows the swivel adapter device at an angle of 90 degrees with respect to the rigidly fixed mounting plate.

Figure 1:
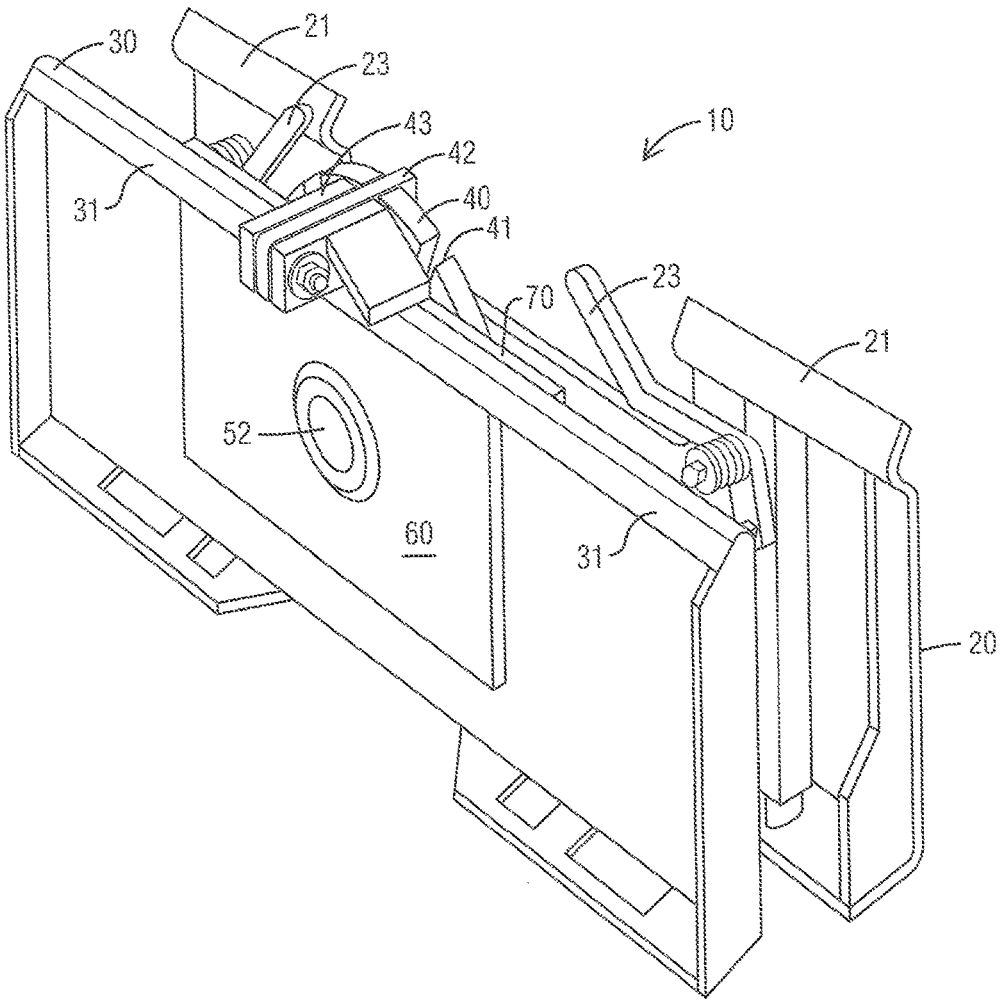
FIG. 1 is a perspective view showing a mounting plate with a locking latch support affixed on a lipped edge of a mounting plate. Further forward from the mounting plate, the locking latch sits in a notch in a notch plate. Further forward still, is a work tool plate and its associated latching handle system.

| DRAWINGS - Reference Numerals | |
|---|---|
| 10 Swivelable adapter device | 20 Work tool plate |
| 21 Work tool plate lip | 22 Work tool plate alignment pin |
| 23 Work. tool plate alignment latch arm | 30 Mounting plate |
| 31 Mounting plate lip | 40 Notch plate |
| 41 Locking latch notch | 42 Locking latch |
| 43 Locking latch support mount | 50 Barrel within a barrel assembly |
| 51 Outer barrel | 52 Inner barrel |
| 53 Grease fitting | 60 Aft reinforcing mounting plate |
| 70 Forward reinforcing mounting plate | 80 Holding ring |
| 90 Reinforcing work tool plate | |

DESCRIPTION OF THE PREFERRED EMBODIMENTS

Figure 2:
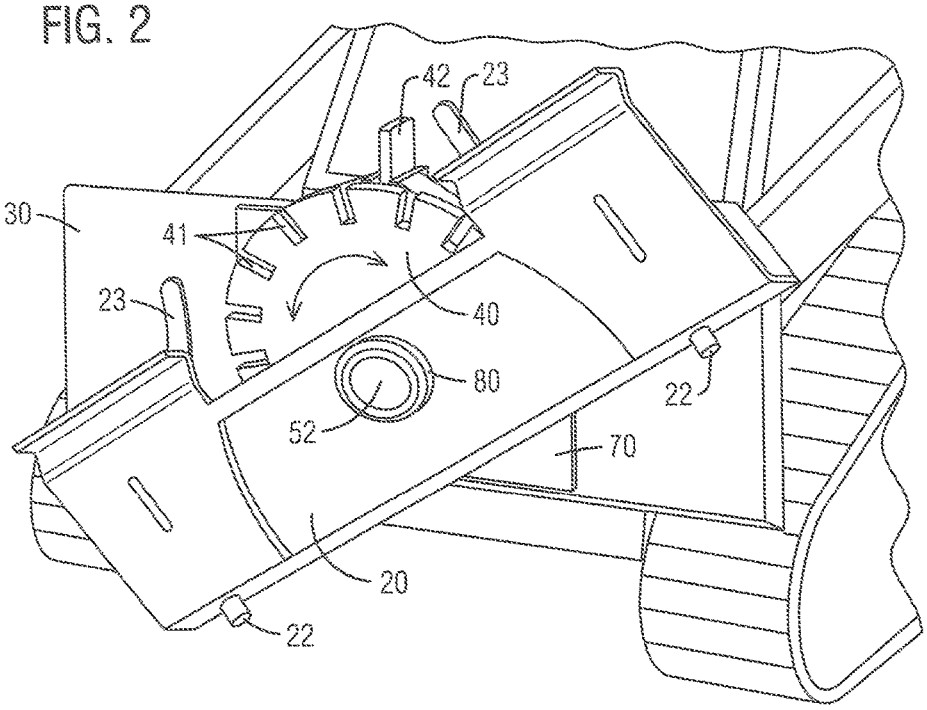
FIG. 2 top view shows the device mounted on a skid steer loader with the mounting plate positioned at a 45-degree angle with respect to horizontal fixed mounting plate.
Figure 3:
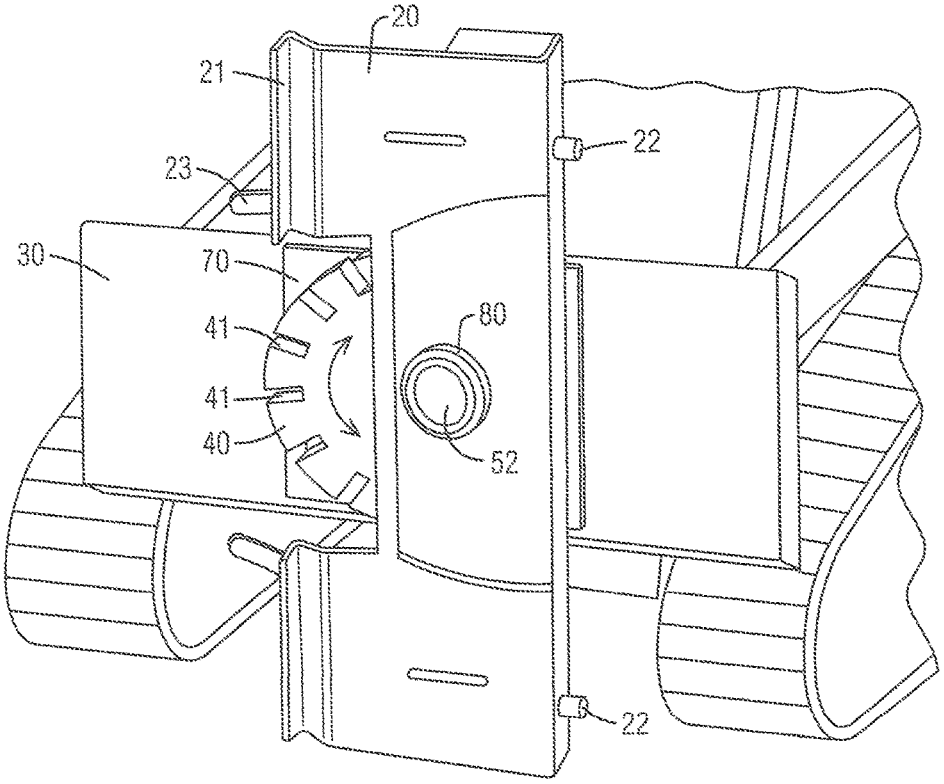
FIG. 3 illustrates the adaptive capability of the swivel adapter device. The swivel adapter device first mounts onto the skid steer. Once the mounting plate is mated to a skid steer loader, the work tool mounts to the work tool plate and is latched using a latching system.
Figure 4:
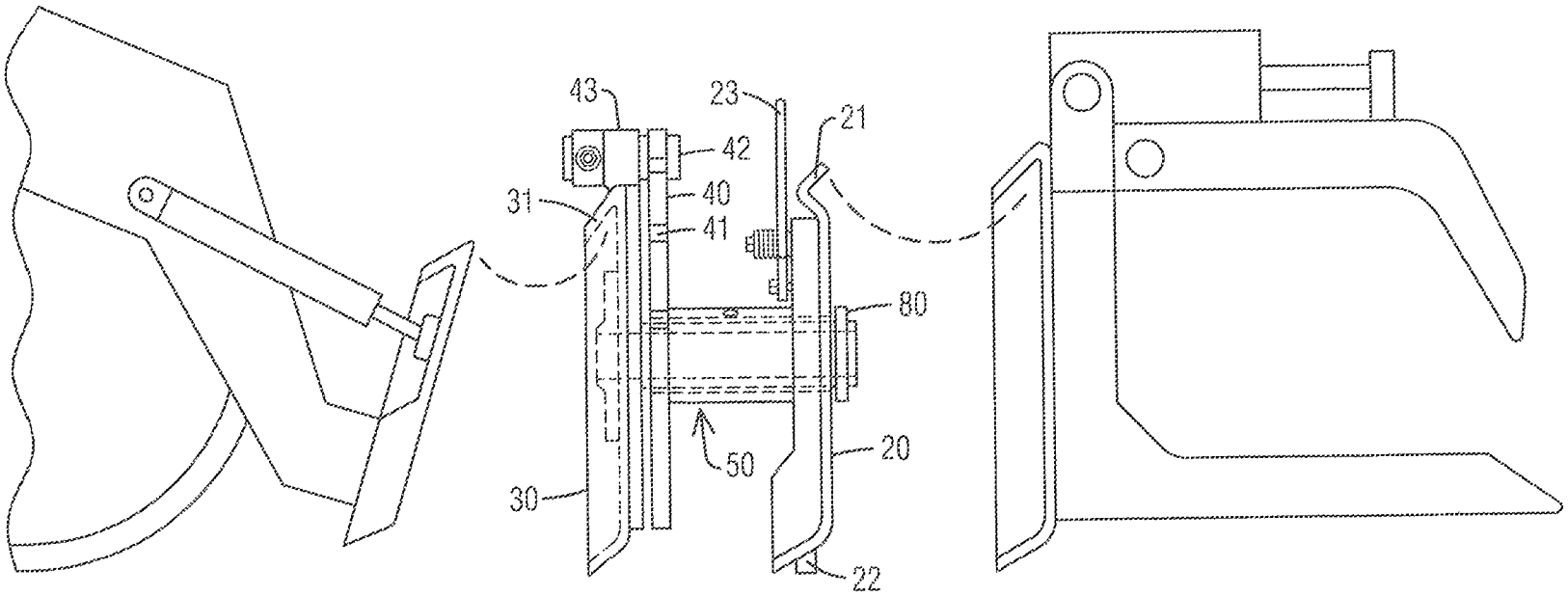
FIG. 4 is an exploded view showing alignment and connectivity of the swivel adapter device subparts.
Figure 5:
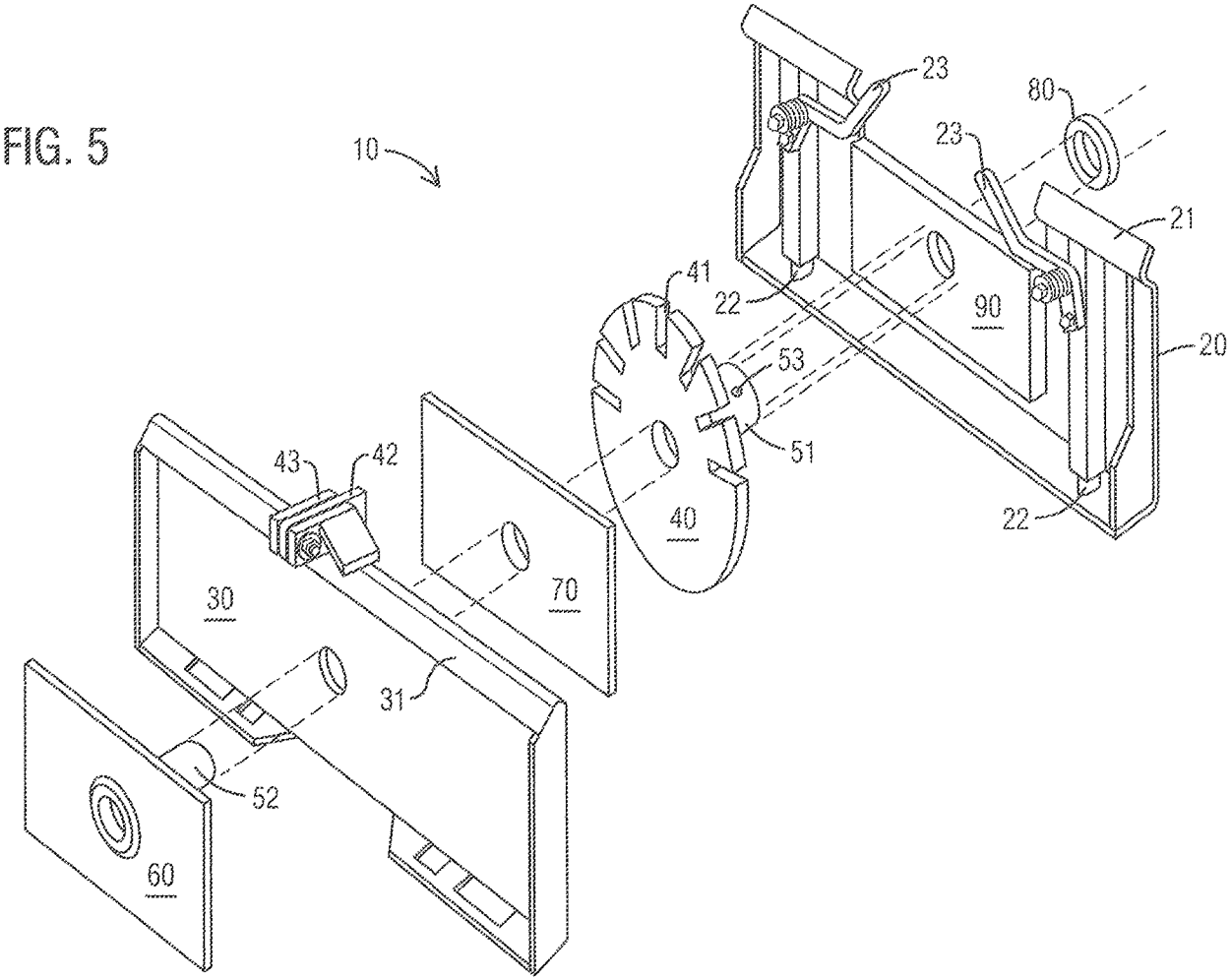
FIG. 5 is a cutaway drawing of the swivel adapter device on a vertical plane along a centerline of the inner barrel.

As best illustrated in FIGS. 2 and 4, the swivelable adapter 10 is intended for use with various industry skid steer loaders to allow adapting work tools to a skid steer loader, and then to allow the work tool to be swiveled to a desired work angle between horizontal and vertical. The present device is an adapter that swivels. The adapter mounts on a skid steer loader, and a work tool then mounts to the adapter.

The swivelable adapter is a series of parallel metal plates rigidly affixed on a set of metal barrels. One set of metal plates is fixed to an inner barrel 52. A second set of plates is affixed to an outer barrel 51. The inner dimension of the outer barrel 51 is greater than the outside dimension of the inner barrel 52 to allow the outer barrel 51 clearance to slide over the inner barrel 52.

The outer barrel 51, with its affixed set of plates, slides over the inner barrel 52 during assembly. The metal plates are a notch plate 40 and a reinforcing work plate 90. The set of metal plates affixed to the inner barrel 52 are an aft reinforcing mounting plate 60 and a forward reinforcing mounting plate 70. The entire swivelable adapter assembly is held together with a holding ring 80 permanently affixed to a forward end of the inner barrel 52 once the outer barrel 51 is slid onto the inner barrel 52 during the assembly process. Once permanently assembled, the outer barrel 51 rotates around the inner barrel 52.

The inner barrel 52 is fitted to a commercial quick attach mount plate machined to precisely accept the outside diameter of the inner barrel 52. The quick attach mounting plate 30 is rigidly affixed to the aft end of the inner barrel 52. Aft is a position closer to the skid steer. The outer barrel 51 is fitted to a commercial quick attach conversion adapter tool work plate that has been modified to provide a reinforcing steel plate with a machined area to allow penetration of the outer barrel 51. Additionally, the outer barrel 51 has a notch plate 40 affixed at an aft end of the outer barrel 51.

The notch plate 40 is a round metal plate with a machined area to allow the outer barrel 51 to penetrate in the center of the notch plate 40. The notch plate 40 is permanently affixed to the aft end of the outer barrel 51.

The quick attach mounting plate 30 that is permanently affixed to the inner barrel 52 at the aft end of the inner barrel 52, act as a mounting surface for skid steer loader arms. The quick attach conversion adapter tool work plate 20, permanently affixed to the outer barrel 51, functions to accept a variety of commercial skid steer attachment work tools, such as grapples. A notch plate 40 is permanently affixed to the outer barrel 51 at an end opposite the tool work plate 20.

A notch plate 40 provides control over rotation of the outer barrel 51 around the inner barrel 52. The notch plate 40 has notches 41 at positions around the circumferential edge of the notch plate 40. The notches 41 are all cut to a depth the same distance from an axis running along a centerline of the inner barrel 52. The notches 41 are machined to a width to accept a locking latch 42.

The swivelable adapter device 10 is fabricated such that the outer barrel 51 rotates around the inner barrel 52 while sliding on a film of grease existing between the outer wall of the inner barrel 52 and the inner wall of the outer barrel 51. A grease fitting 53 is provided for application of grease between the inner barrel 52 and the outer barrel 51.

Both the mounting plate 30 and the tool work plate 20 have industry-standard lipped holding edges for attachment purposes. The mounting plate lip 31 is formed on the upper edge of the mounting plate 30. This mounting plate lip 31 accepts the arms of a skid steer loader. The work plate lip 21 is formed on the upper edge of the tool work plate 20. The tool work plate lip 21 accepts various work tool attachments.

The tool work plate 20 is fitted with work plate alignment pins 22 to fit an attached work tool snugly to the tool work plate 20. A work plate alignment latch arm 23 is provided to position the work plate alignment pin 22 into the alignment area of an attached work tool.

The mounting plate 30 is snuggly attached to the skid steer lifting arms using alignment pins and latching arms provided on the skid steer loader. The swivelable adapter device 10 mounting plate 30 includes alignment areas to receive the skid steer loader alignment pins. With the swivelable adapter device 10 mounted on a skid steer loader using the mount plate 30, the mounting plate 30 is fixed in position with the skid steer loader lifting arms.

Reinforcing plates are provided to account for forces imparted by the swivelable adapter carrying heavy loads, such as a large, fallen tree. The mounting plate 30 has two reinforcing plates permanently affixed to the mounting plate 30. A forward reinforcing mounting plate 70 and an aft reinforcing mounting plate 60 prevent deformation of the mounting plate 30 during operation and use of the swivelable adapter device 10.

Reinforcing work plate 90 prevents deformation of the tool work plate 20 during operation and use of the swivelable adapter device 10. The barrel within a barrel assembly 50, utilizing close tolerances, provides structural strength to lift large loads without deformation of the swivelable adapter device.

A locking latch 42 is the means to lock the swivelable adapter device 10 at various chosen pivotal attitudes. The locking latch 42 is affixed on the upper surface mounting plate lip 31 in a position that is above a centerline that runs through the inner barrel 52. The locking latch 42 is supported to allow positioning of the locking latch 42 in a locking latch notch 41 in the notch plate 40 when manual movement accomplishes rotation of the tool work plate 20 to a desired angle. A locking latch support mount 43 is permanently affixed to the top edge of the mounting plate lip 31 and in the center of the mounting plate 30 so the locking latch 42 is inline with the centerline of an axis running longitudinally with the inner barrel 52. The locking latch support mount 43 holds the locking latch 42 and allows the locking latch 42 to pivot up or down. The locking latch 42 is pivoted up to release from the notch plate 40 so the notch plate 40 is free to turn by hand. Lowering the locking latch 42 allows the locking latch 42 to occupy a locking latch notch 41 for a locking latch 42 thereby creating a lock to preventing movement of the tool work plate 20 affixed to the forward end of the outer barrel 51. When the locking latch 42 is swung into a notched position, the tool work plate 20 is fixed in position with respect to the skid steer mounting plate 30 thereby affixing the mounting plate 30 in position with regard to the skid steer. The tool work plate 20 may now rotate in a range from horizontal to vertical, either in a direction to the left or to the right, to orient a work tool implement.

The tool work plate 20 can be rotated or swiveled about an axis that is the longitudinal centerline of the inner barrel 52. Rotating the outer barrel 51 about the inner barrel 52 permits swiveling of the attached work tool because the tool work plate 20 moves with the outer barrel 51. A grease film between the inner barrel 52 and the outer barrel 51 provides a low coefficient of friction. When the swivelable adapter device 10 is mounted to a skid steer loader and loaded with a work tool on the tool work plate 20, the outer barrel 51 can be rotated using hand force. Hand rotation capability precludes the need for hydraulic systems to cause rotation of the work tool plate 20.

The position of a work tool can be easily changed by unlatching the locking latch 42, rotating the forward work tool plate 20, and re-latching the locking latch 42 in a different locking latch notch 41 position. The position locking capability provides for a whole set of different angles, from horizontal to vertical, with which to position the work tool plate 20, and therefore different angles to position a work tool implement.

A skid steer loader operator can now attach a work tool implement, set an angle from horizontal to vertical, as desired, and utilize a work tool implement at that positioned angle. This angle changing capability allows, for example, the use of a skid steer loader to extricate a tree leaning at a severe angle. Such a situation occurs frequently following windstorms, like hurricanes, that blow trees down. Some trees are not blown down flat and may rest precariously at angles between horizontal and vertical. Often such trees rest against structures, carrying potential energy. The removal of a leaning tree against a structure is easily and safely accomplished utilizing the swivelable adapter device 10.

The work tool plate 20 can be swiveled manually by hand. No hydraulic actuation force is needed to cause rotation. This fact is significant because there are a wide variety of different skid steer loader manufacturers in the commercial market. Each manufacturer may have a unique hydraulic hose and control connection setup. The swivelable adapter device 10 is fabricated to rotate easily by hand. Because the swivelable adapter device 10 does not need hydraulics, the device can be utilized on a variety of skid steer loader, regardless of the type of hydraulic system setup.

Work tool plate alignment latch arms 23 to operate the work tool plate alignment pins 22 are also provided on the work tool plate 20. These work tool plate alignment pins 22 and work tool plate alignment latch arm 23 are common to the field of art.

The notch plate 40 is a circular mass of plate metal machined to assist in balancing loads during rotation of the work tool plate 20 that is permanently affixed to the outer barrel 51.

ADVANTAGES

The advantage of a skid steer loader swivelable adapter that rotates is to allow a skid steer loader to be a multi-use tool for small business owners. A tree removal job that would normally takes hours can be accomplished in minutes with fewer people on the work crew. The swivelable adapter device fits on multiple skid steer loaders. The tool does not need hydraulics so it is not limited to skid steer loaders with manufacturer specific hydraulic hookup features. The swivelable adapter device rotates from horizontal to vertical and locks to orient a work tool implement to a work load.

CONCLUSION, RAMIFICATIONS AND SCOPE

Although the present invention has been described in considerable detail with reference to certain preferred versions thereof, other versions are possible. Therefore, the spirit and scope of the appended claims should not be limited to the description of the preferred version contained therein. The reader's attention is directed to all papers and documents, which are filed concurrently with this specification and are open to public inspection with this specification, and the contents of all such papers and documents, are incorporated herein by reference. All features disclosed in this specification, including any accompanying claims, abstract, and drawings, may be replaced by alternative features serving the same, equivalent or similar purpose, unless expressly stated otherwise.

What I claim is:

1. A swivelable adapter device for a skid steer loader comprising:

a mounting plate;

a forward reinforcing mounting plate;

an aft reinforcing mounting plate affixed to an inner barrel, the aft reinforcing plate contacting the mounting plate, the forward reinforcing mounting plate contacting the mounting plate, the mounting plate being positioned between the forward reinforcing mounting plate and the aft reinforcing mounting plate;

a work tool plate affixed to an outer barrel; and a notch plate contacting the forward reinforcing plate and coupled to the outer barrel, the notch plate engaging a locking latch, wherein an outer barrel inside dimension is greater than an inner barrel outside dimension to allow clearance for said outer barrel to slide over said inner barrel, wherein said work tool plate is affixed to said outer barrel, said outer barrel is slid over said inner barrel during assembly, wherein the swivelable adapter device is held together with a holding ring permanently affixed near a forward end of said inner barrel once said outer barrel is slid onto said inner barrel, and when once permanently assembled, said outer barrel is rotatable around said inner barrel, causing rotation of said work tool plate, the notch plate and locking latch holding said work tool plate in various positions after said work tool plate is rotated.

2. The swivelable adapter device of claim 1, wherein said mounting plate is machined to accept the inner barrel outside diameter and wherein said mounting plate is rigidly affixed near an end of said inner barrel.

3. The swivelable adapter device of claim 1, wherein said work tool plate is machined to allow passage of said inner pipe through said work tool plate so as to establish a clearance between said inner barrel and said work tool plate.

4. The swivelable adapter of claim 1, wherein a reinforcing work tool plate is machined to accept an outer barrel outside diameter and wherein said reinforcing work tool plate is permanently affixed to said outer barrel near a forward end of said outer barrel and wherein said reinforcing work tool plate is permanently affixed to said work tool plate on an aft side of said work tool plate.

5. The swivelable adapter device of claim 1, wherein said outer barrel is permanently joined to said work tool plate at a forward end of said outer barrel and at an aft side of said work tool plate.

6. The swivelable adapter device of claim 1, wherein said mounting plate that is permanently affixed to said inner barrel near an aft end of said inner barrel, acts as a mount surface for skid steer loader arms of the skid steer loader.

7. The swivelable adapter device of claim 1, wherein said work tool plate is permanently affixed to said outer barrel and therein functions to accept a variety of commercial skid steer attachment work tools.

8. The swivelable adapter device of claim 1, wherein when said swivelable adapter device is mounted on a skid steer loader using said mounting plate, such that said mounting plate is fixed in position with skid steer loader lifting arms.

9. A swiveable adapter device for a skid steer loader comprising:

a mounting plate;

a forward reinforcing mounting plate;

an aft reinforcing mounting plate affixed to an inner barrel, the aft reinforcing plate contacting the mounting plate, the forward reinforcing mounting plate contacting the mounting plate, the mounting plate being positioned between the forward reinforcing mounting plate and the aft reinforcing mounting plate;

a work tool plate affixed to an outer barrel; and a notch plate contacting the forward reinforcing plate and coupled to the outer barrel, the notch plate engaging a locking latch, wherein an outer barrel inside dimension is greater than an inner barrel outside dimension to allow clearance for the outer barrel to slide over the inner barrel, wherein said work tool plate is affixed to the outer barrel, the outer barrel is slid over the inner barrel during assembly, and wherein when once permanently assembled, the outer barrel is rotatable around the inner barrel, causing rotation of the work tool plate, the notch plate and locking latch holding the work tool plate in various positions after the work tool plate is rotated.

10. The swivelable adapter device of claim 9, wherein the swivelable adapter device is held together with a holding ring permanently affixed near a forward end of the inner barrel once the outer barrel is slid onto the inner barrel.

11. The swivelable adapter device of claim 9, wherein the work tool plate functions to accept a variety of commercial skid steer attachment work tools.

12. The swivelable adapter device of claim 9, wherein the locking latch is coupled to the mounting plate.

13. The swivelable adapter device of claim 9, wherein the notch plate comprises a plurality of notches that engage with the locking latch.

14. The swivelable adapter device of claim 13, wherein the plurality of notches extend along an outer periphery of the notch plate over a distance comprising about one-half of a circumference of the notch plate.

15. A swiveable adapter device for a skid steer loader comprising:

a mounting plate;

a forward reinforcing mounting plate;

an aft reinforcing mounting plate affixed to an inner barrel, the aft reinforcing plate contacting the mounting plate, the forward reinforcing mounting plate contacting the mounting plate, the mounting plate being positioned between the forward reinforcing mounting plate and the aft reinforcing mounting plate;

a work tool plate affixed to an outer barrel; and means for holding the work tool plate in various positions, the means for holding contacting the forward reinforcing plate and coupled to the outer barrel, wherein an outer barrel inside dimension is greater than an inner barrel outside dimension to allow clearance for the outer barrel to slide over the inner barrel, wherein said work tool plate is affixed to the outer barrel, the outer barrel is slid over the inner barrel during assembly, and wherein when once permanently assembled, the outer barrel is rotatable around the inner barrel, causing rotation of the work tool plate, the means for holding secures the work tool plate in a second position after the work tool plate is rotated from the first position to the second position.

16. The swivelable adapter device of claim 15, wherein the means for holding comprises a notch plate engaging a locking latch.

17. The swivelable adapter device of claim 16, wherein the locking latch is coupled to the mounting plate.

18. The swivelable adapter device of claim 16, wherein the notch plate comprises a plurality of notches that engage with the locking latch.

19. The swivelable adapter device of claim 18, wherein the plurality of notches extend along an outer periphery of the notch plate over a distance comprising about one-half of a circumference of the notch plate.

20. The swivelable adapter device of claim 15, wherein the work tool plate functions to accept a variety of commercial skid steer attachment work tools.

* * * * *